US007274900B2

(12) United States Patent
Shimmura

(10) Patent No.: US 7,274,900 B2
(45) Date of Patent: Sep. 25, 2007

(54) COLOR IMAGE FORMING APPARATUS AND IMAGE FORMING METHOD

(75) Inventor: Shoko Shimmura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 115 days.

(21) Appl. No.: 10/944,011

(22) Filed: Sep. 20, 2004

(65) Prior Publication Data

US 2006/0062608 A1 Mar. 23, 2006

(51) Int. Cl.
*G03G 15/01* (2006.01)
*G03G 15/16* (2006.01)

(52) U.S. Cl. ..... 399/298; 399/302

(58) Field of Classification Search ..... 399/298, 399/299, 223, 302; 347/115, 117
See application file for complete search history.

(56) References Cited

U.S. PATENT DOCUMENTS

| | | | | |
|---|---|---|---|---|
| 6,173,141 | B1 * | 1/2001 | Sakagami et al. | 399/167 |
| 6,324,374 | B1 * | 11/2001 | Sasamoto et al. | 399/298 |
| 2001/0031413 | A1 * | 10/2001 | Anno et al. | 430/107.1 |
| 2003/0129006 | A1 * | 7/2003 | Hoshi et al. | 399/298 |

FOREIGN PATENT DOCUMENTS

| | | | |
|---|---|---|---|
| JP | 3-214174 | A | 9/1991 |
| JP | 05-341617 | A * | 12/1993 |
| JP | 07-244414 | A * | 9/1995 |
| JP | 9-120190 | A | 5/1997 |
| JP | 10-055094 | A * | 2/1998 |
| JP | 2001-75331 | A | 3/2001 |
| JP | 2001-175048 | A * | 6/2001 |
| JP | 2001-175091 | A * | 6/2001 |
| JP | 2002/169339 | A * | 6/2002 |
| JP | 2002-182447 | A * | 6/2002 |
| JP | 2004-029056 | A * | 1/2004 |
| JP | 2004-205943 | A * | 7/2004 |
| JP | 2004-205944 | A * | 7/2004 |

* cited by examiner

*Primary Examiner*—Sophia S. Chen
(74) *Attorney, Agent, or Firm*—Foley & Lardner LLP

(57) ABSTRACT

A color image forming apparatus includes an image forming section that is configured to adopt an intermediate transfer system for three colors of cyan, magenta and yellow, and a direct transfer system for black. A transfer medium is conveyed to a transfer medium convey belt. Cyan, magenta and yellow are intermediately transferred by an intermediate transfer belt and a secondary transfer roller. Black is directly transferred by a black photoconductor body and a transfer roller. Toners of the respective colors are fixed by a fixing device.

16 Claims, 4 Drawing Sheets

COLOR IMAGE FORMING APPARATUS AND IMAGE FORMING METHOD

BACKGROUND OF THE INVENTION

1. Field of the Invention

The present invention relates to a color image forming apparatus and an image forming method, which can print a full-color image and a monochromatic image.

2. Description of the Related Art

In the prior art, an electrophotographic full-color image is formed of four color toners comprising a black toner and three process color toners of cyan, magenta and yellow.

A color image forming apparatus is first described.

There is known a tandem-type color image forming apparatus wherein four-color image forming units (each comprising a photoconductor body, a charging device, an exposure device, a developing device and a transfer device) are arranged over a transfer medium (of direct type or indirect type) and a full-color image is formed by single passage of the transfer medium. There is also known a 4-rotation type color image forming apparatus wherein four-color developing devices and a single photoconductor body unit (comprising a photoconductor body, a charging device, an exposure device and a transfer device) are provided and, in a case of forming a four-color image, a transfer medium (of direct type or indirect type) is rotated four times and four-color toner images are overlapped, thereby forming a full-color image. In short, color image forming apparatuses fall into two categories: tandem type and 4-rotation type.

In the case of the tandem type, a full-color image is formed by single passage of the transfer medium. On the other hand, in the case of the 4-rotation type, an approximately four times longer time is needed for image formation. The tandem type is more advantageous for high-speed full-color image formation.

A full-color (chromatic) toner, however, requires more transparency than a monochromatic (achromatic) toner in order to increase a color reproduction range. In order to obtain desired transparency, the full-color toner requires a more quantity of heat for fixation than the monochromatic toner. Hence, it is difficult to increase the printing speed of the full-color image forming apparatus up to a level of a dedicated monochromatic image forming apparatus.

When a monochromatic single-color image is to be formed, it is desirable to stop the operations of non-used color image forming units in order to prevent degradation of replaceable parts or consumable parts. Although this is possible in the structure of the tandem type, the mechanism becomes complex and there is difficulty.

On the other hand, in the 4-rotation type, the speed for forming a full-color image is low, but it should suffice if only necessary color developing units are put in contact with the photoconductor body. Thus, when a monochromatic single-color image is formed by the 4-rotation type, a printing speed that is substantially equal to that of the tandem type can be obtained, and the non-used color developing units may be stopped. Thus, no special mechanism for preventing degradation is needed. Furthermore, since only one photoconductor unit is used, the size of the apparatus can be made smaller than in the tandem type.

As has been described above, the tandem type and 4-rotation type have advantages and disadvantages. It is difficult to meet all the requirements for the color image formation speed, prevention of degradation in consumable parts, and simple structure.

Next, cleaning is described.

With a cleaning device, a cleaning blade abrades a surface layer of the photoconductor body, leading to a decrease in life of the photoconductor body. A simultaneous development/cleaning process can increase the life of the photoconductor body by dispensing with the cleaning device. In this process, residual toner after primary transfer is recovered from a development area into each developing device. This process is feasible in the tandem type since photoconductor bodies are provided for the respective colors, but it is substantially unfeasible in the 4-rotation type.

Next, a transfer method is described.

Transfer methods fall into two categories: a direct transfer method and an indirect transfer method. In the direct transfer method, a photoconductor body and a transfer medium, such as paper, are put in direct contact, and a toner image is transferred. In the indirect transfer method, a toner image is once transferred from a photoconductor body to an intermediate transfer member, and then the toner image is secondarily transferred from the intermediate transfer member to a transfer medium such as paper. Since the toner image is gradually degraded as it passes through process steps, the direct transfer method, in which the toner image is only once transferred from the photoconductor body to the transfer medium, is advantageous in consideration of specks of toner.

Since 100% of toner is not transferred, loss of toner due to post-transfer residual toner is minimized if the number of times of transfer is one.

The conditions of the fed transfer medium (e.g. thickness of paper, surface smoothness, moisture ratio due to environmental conditions, etc.) are variable. Thus, in the direct transfer method, it is difficult to keep constant the transfer potential conditions at four direct transfer locations. In the direct transfer method, the color reproduction varies if the transfer efficiency slightly varies. Consequently, it is difficult to obtain stable color reproducibility.

On the other hand, in the indirect transfer method, the possibility of degradation in image quality due to dispersion of toner is higher than in the direct transfer method, and the loss of toner due to occurrence of post-transfer residual toner may possibly be greater. However, four color toners are overlapped on the intermediate transfer member that is kept in the fixed environmental condition within the apparatus. It is thus easier to maintain the image quality, compared to the case where toners are overlapped directly on the final transfer medium. Furthermore, the indirect transfer method requires only one-time transfer to the final transfer medium that is unstable in terms of conditions, so the effect due to a variation in transfer conditions such as environment can be minimized. Therefore, such an advantage is obtained that the color reproducibility of color images can easily be made uniform. Besides, the degree of freedom is high in the design of the transfer path for the final transfer medium.

As has been described above, both the direct transfer method and indirect transfer method have advantages and disadvantages in terms of the image quality and toner consumption efficiency.

Jpn. Pat. Appln. KOKAI Publication No. 03-214174 discloses a technique wherein in a color print mode, a toner image is indirectly transferred to a transfer medium via an intermediate transfer member, and in a monochromatic print mode, a toner image is directly transferred to a transfer medium. In this method, four color developing devices are arranged around a single photoconductor body, and the photoconductor body is rotated by the number of times, which corresponds to the number of colors, thereby forming a color image. In this method, there is a large difference in printing speed between a full-color image and a monochromatic image, and the customers' needs cannot be satisfied. At the time of full-color image formation, black toner, as well as chromatic toners, is subjected to an intermediate transfer process step. Consequently, the sharpness of a black image in a full-color image cannot be expected.

Jpn. Pat. Appln. KOKAI Publication No. 09-120190 discloses a color recording apparatus having a first mode, in which toner on a photoconductor body is directly transferred, and a second mode, in which the toner is intermediately transferred. In the second mode, the intermediate transfer belt rotates in a first direction for transfer from the photoconductor body, and in a direction opposite to the first direction, for transfer from the intermediate transfer belt to a transfer medium. However, to change the direction of rotation of the intermediate transfer member according to the modes requires a complex mechanism and is not desirable. In addition, reverse rotation in the intermediate transfer method makes it necessary to reverse image data, and this disadvantageously leads to a complex process. In this method, too, in the case of a full-color image, black toner is also transferred to a transfer medium via intermediate transfer. Consequently, the sharpness of a black image cannot be achieved.

Jpn. Pat. Appln. KOKAI Publication No. 2001-75331 discloses a technique wherein post-transfer residual toner on an intermediate transfer member is re-charged with an opposite polarity by a re-charging device, and transferred at a transfer position of a black image carrying body that is located at the most upstream part of the intermediate transfer member. In this invention, a black image forming unit is disposed at the most upstream part of the intermediate transfer member. On the downstream side of the black image forming unit, cyan, magenta and yellow image forming units are arranged. In the order of arrangement of image forming units, toners are overlapped on the intermediate transfer member and are transferred at a time on a final transfer medium in a secondary transfer section. In this case, in the image part on which a plurality of color toners overlap on the intermediate transfer member, a black toner that is far from the transfer medium is least easily transferred, and it is highly possible that residual toner occurs after transfer. Consequently, a black character on a color background, for instance, is not clearly transferred, and a line-width may become inadequate due to low density. Moreover, the sharpness of an edge part would disadvantageously be lost.

BRIEF SUMMARY OF THE INVENTION

The object of an aspect of the present invention is to provide a color image forming apparatus and an image forming method, which can meet requirements relating to the image quality and printing speed of a full-color image and a monochromatic image, and can enhance toner consumption efficiency.

According to an aspect of the present invention, there is provided a color image forming apparatus that has a plurality of image carrying bodies and forms a color image, comprising: first image forming means for forming a toner image of a chromatic color other than black; primary transfer means for transferring the toner image, which is formed by the first image forming means, to an intermediate transfer member; secondary transfer means for transferring the toner image, which is transferred to the intermediate transfer member by the primary transfer means, to a transfer medium; second image forming means for forming a black toner image; and direct transfer means for directly transferring the black toner image, which is formed by the second image forming means, to the transfer medium on which the toner image is transferred by the secondary transfer means.

According to another aspect of the present invention, there is provided an image forming method for a color image forming apparatus that has first and second image carrying bodies and forms a color image, comprising: primarily transferring a toner image of a chromatic color other than black, which is formed using the first image carrying body, to an intermediate transfer member; secondarily transferring the toner image of the chromatic color other than black, which is primarily transferred to the intermediate transfer member, to a transfer medium; and directly transferring a black toner image, which is formed using the second image carrying body, to the transfer medium on which the toner image is secondarily transferred.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of an aspect of the invention.

DETAILED DESCRIPTION OF THE INVENTION

Embodiments of the present invention will now be described with reference to the accompanying drawings.

Figure 1:
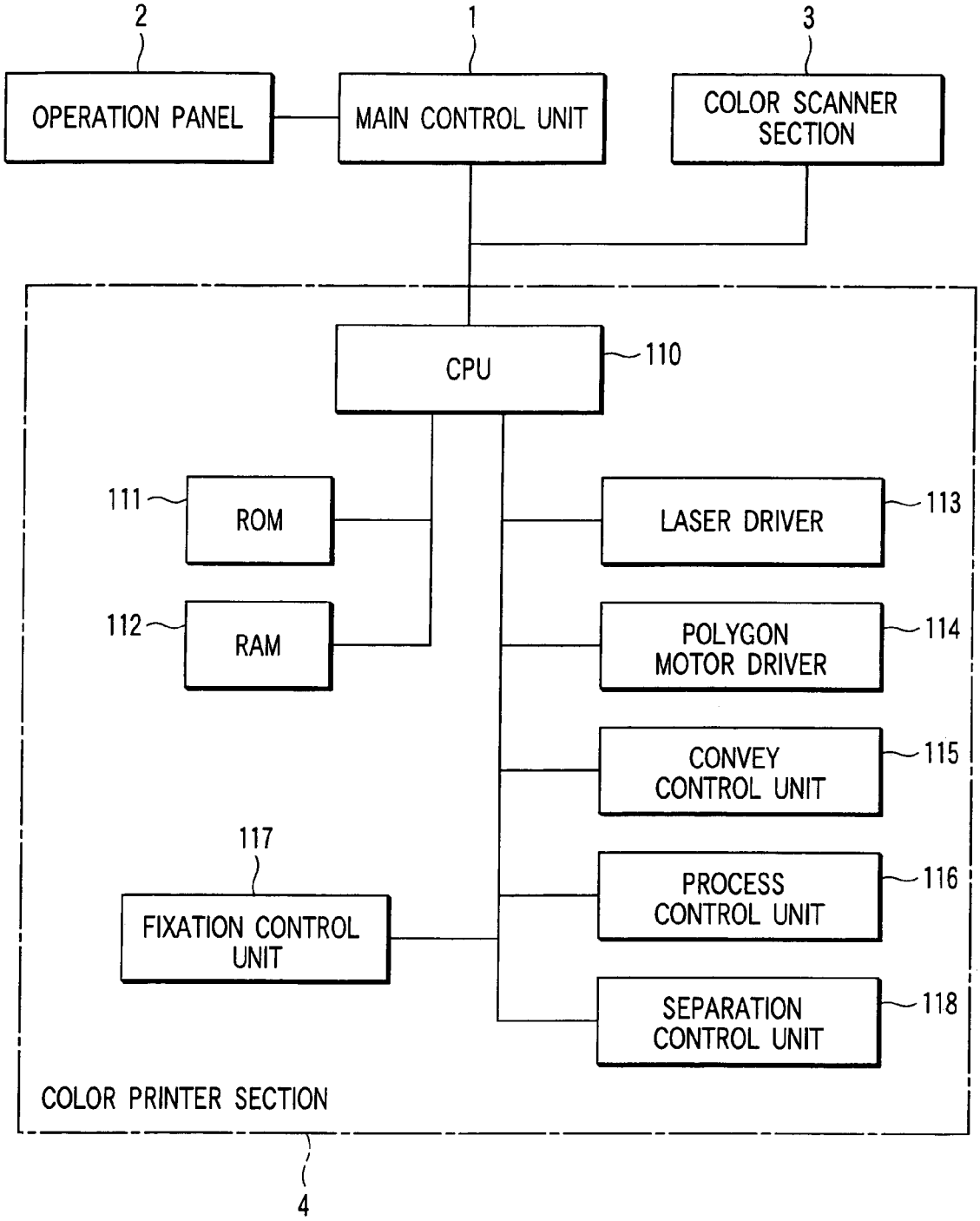
FIG. 1 is a block diagram showing the structure of a control system of an image forming apparatus according to an embodiment of the present invention.

FIG. 1 shows the structure of a control system of an image forming apparatus according to an embodiment of the present invention. The image forming apparatus comprises a main control unit 1 for executing an overall control, an operation panel 2 for executing various settings, a color scanner section 3 serving as image reading means for reading a color image on an original, and a color printer section 4 serving as image forming means for forming an image.

The color printer section 4 comprises a CPU 110 for executing an overall control; a ROM 111 that stores a control program, etc.; a RAM 112 for storing data; a laser driver 113 that drives a semiconductor laser of a laser optical system (not shown); a polygon motor driver 114 that drives a polygon motor (not shown); a convey control unit 115 that controls conveyance of paper; a process control unit 116 that controls processes of charging, development and transfer using a charging device, a developing roller and a transfer device (all not shown); a fixation control unit 117 that controls a fixing device (not shown); and a separation control unit 118 that controls separation of an intermediate transfer belt.

Next, a first embodiment is described.

Figure 2:
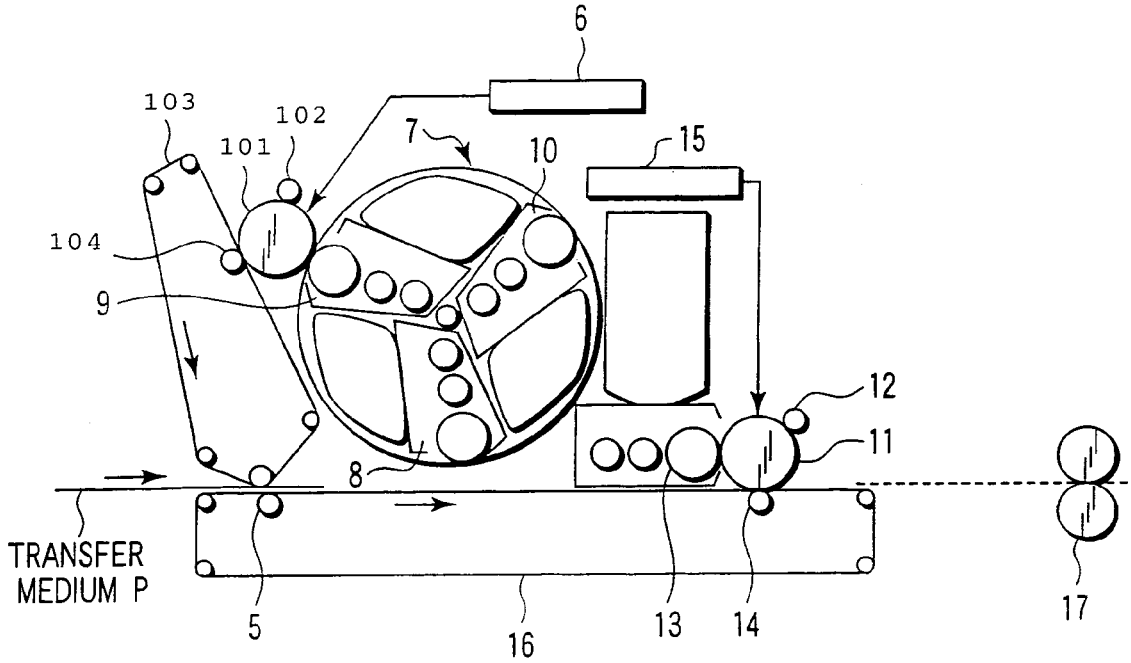
FIG. 2 schematically shows the structure of an image forming apparatus according to a first embodiment.

FIG. 2 schematically shows the structure of an image forming section according to the first embodiment. The image forming section of the first embodiment is configured to execute intermediate transfer of chromatic toners and direct transfer of black toner.

An intermediate transfer section comprises a photoconductor body 101 for chromatic colors, a charging roller 102, an intermediate transfer belt 103, a primary transfer roller 104, a secondary transfer roller 5, a laser optical system 6, and a rotary developing unit 7. The developing unit 7 has a rotary configuration, and comprises a cyan developing device 8, a magenta developing device 9 and a yellow developing device 10.

A direct transfer section comprises a photoconductor body 11 for black, a charging roller 12, a black developing device 13, a transfer roller 14, and a laser optical system 15 for black.

A transfer medium P is conveyed to a transfer medium convey belt 16. Cyan, magenta and yellow toners are transferred on the transfer medium P by the intermediate transfer belt 103 and secondary transfer roller 5 by an intermediate transfer method. Black toner is directly transferred on the transfer medium P by the photoconductor body 11 and transfer roller 14, and the respective color colors are fixed on the transfer medium P by a fixing device 17.

The developing device 8 contains a two-component electrophotographic developer as a chromatic developing agent, which comprises a cyan toner and a magnetic carrier. The developing device 9 contains a two-component electrophotographic developer as a chromatic developing agent, which comprises a magenta toner and a magnetic carrier. The developing device 10 contains a two-component electrophotographic developer as a chromatic developing agent, which comprises a yellow toner and a magnetic carrier.

Next, a description is given of an image forming operation under the control of the printer CPU 110 in the apparatus with the above-described structure.

The surface of the photoconductor body 101 for chromatic colors is substantially uniformly charged with positive or negative electricity by the charging roller 102. An electrostatic latent image is formed on the photoconductor body 101 by the laser optical system 6, which emits a laser beam in accordance with yellow image information. Then, the yellow developing device 10 is rotated to a position facing the photoconductor body 101 thus developing the electrostatic latent image on the photoconductor body 101.

At this time, when each developing device 8, 9, 10 is rotated and opposed to the photoconductor body, a DC or a DC+AC development bias is applied. The yellow toner that is supplied from the yellow developing device 10 is charged with the same polarity as the surface potential of the photoconductor body 101. The photoconductor body 101 rotates and conveys the toner image to a primary transfer area. The toner image on the photoconductor body 101 is transferred onto the intermediate transfer belt 103 by a transfer bias that is applied from the back side of the intermediate transfer belt 103 by the primary transfer roller 104.

The intermediate transfer belt 103 has a circumferential length corresponding to the length of an integer-number of images. Toner images of a first color, which correspond to an integer-number of images, are formed on the intermediate transfer belt. For example, in a case where the intermediate transfer belt 103 has a circumferential length of 43 cm or more, i.e. a vertical dimension of an "A3" sheet or more, the circumferential length corresponds to double the horizontal dimension of an "A4" sheet. That is, image data corresponding to two "A4" sheets is formed by a single circumferential length of the intermediate transfer belt.

Subsequently, the developing unit 7 is rotated over 120°, and the next magenta developing device 9 is opposed to the photoconductor body 101. The surface of the photoconductor body 101 is substantially uniformly charged by the charging roller 102. An electrostatic latent image is formed on the photoconductor body 101 by the laser optical system 6, which emits a laser beam in accordance with magenta image information. Further, the magenta developing device 9 develops the electrostatic latent image on the photoconductor body 101. The magenta image on the photoconductor body 101 is registered with the yellow image on the intermediate transfer belt 103, and is transferred over the yellow image.

Then, the developing unit 7 is further rotated over 120°, and the next cyan developing device 8 is opposed to the photoconductor body 101. The surface of the photoconductor body 101 is substantially uniformly charged by the charging roller 102. An electrostatic latent image is formed on the photoconductor body 101 by the laser optical system 6, which emits a laser beam in accordance with cyan image information. Further, the cyan developing device 8 develops the electrostatic latent image on the photoconductor body 101. The cyan image on the photoconductor body 101 is registered with the yellow image and magenta image on the intermediate transfer belt 103, and is transferred over them.

Thus, a toner image, on which three colors of an integer-number of images overlap, is formed on the intermediate transfer belt 103.

At a predetermined timing, a transfer medium P is fed onto the convey belt 16 from a paper feed tray (not shown). The three-color toner image is transferred at a time to the transfer medium P by the second transfer roller 5 at a secondary transfer position where the intermediate transfer belt 103 is opposed to the convey belt 16.

Further, at a predetermined timing, the photoconductor body 11 for black is substantially uniformly charged with positive or negative electricity by the charging roller 12. An electrostatic latent image is formed on the photoconductor body 11 by the laser optical system 15, which emits a laser beam in accordance with black image information. Then, the black developing device 13 is rotated to a position facing the photoconductor body 11, thus developing the electrostatic latent image on the photoconductor body 11. At this time, a DC or a DC+AC development bias is applied to the developing device 13. The black toner image is conveyed by the rotation of the black photoconductor body 11 to a transfer position facing the convey belt 16, at the same timing as the transfer medium P, on which the three-color toner is transferred at the secondary transfer position, is conveyed. The black toner image is registered and transferred to the transfer medium P over the three-color toner image by a transfer bias that is applied from the back side of the convey belt 16 by the transfer roller 14.

The transfer medium P, on which the four-color toner image is transferred, is separated from the convey belt 16 and guided into the fixing device 17. The toner image is fixed with heat and pressure by the fixing device 17 and the transfer medium P with the fixed image is output.

In this embodiment, the chromatic toners are developed and transferred in the order of yellow, magenta and cyan. However, the order is not limited.

The charging means for the photoconductor body may be a publicly known charger device such as a corona charger (a charger wire, a comb-teeth charger, a scorotron, etc.), a contact charger roller, a non-contact charger roller, or a solid charger.

In the embodiment, the laser optical system 6, 15 is described as the exposure device. Alternatively, other publicly-known exposing means, such as LEDs, may be used.

In the embodiment, the transfer roller 104, 5 is described as the transfer means. Alternatively, other publicly-known transfer devices, such as a transfer blade and a corona charger, may be used.

In the embodiment, the photoconductor drum, the intermediate transfer belt and the convey belt are combined by way of example. These elements may be replaced with a photoconductor belt, an intermediate transfer drum and a transfer medium conveying drum, respectively.

This embodiment adopts, by way of example, the method wherein the intermediate transfer member, which serves as the image forming means using chromatic developers, is rotated three times and three color toners are overlapped. Alternatively, other configurations may be adopted without departing from the spirit of the present invention.

In this embodiment, a cleaning member for the photoconductor body or the transfer belt is not mentioned. Such a cleaning member may be provided. When transfer to a transfer medium is executed, the resistance of the transfer medium, the temperature and humidity of the inside an outside of the image forming apparatus, etc. may be measured, and an optimal transfer bias may be applied depending on cases.

In addition, when transfer to the intermediate transfer belt is executed, the temperature and humidity of the inside of the machine, the amount of developer toner, etc. may be measured, and an optimal transfer bias may be chosen.

In order to minimize the possibility that an error in feeding of transfer medium paper causes the operation of the apparatus to stop in the state in which a large amount of non-transferred toner remains on the photoconductor body or the intermediate transfer member, it is better to start paper feed immediately after a print start instruction is input, and to make the transfer medium stand by just before the secondary transfer position of the three-color toner. Thereby, erroneous paper feed is detected at a beginning of the printing process step. Hence, the image forming step can be immediately stopped, and waste of toner can be prevented.

Examples of the potentials to be set are as follows: the charging roller potential=−600V (DC)+1.5 kVPP2 kHz (AC); the development bias=−400V (DC); the primary transfer bias to the intermediate transfer belt=+300V (DC: the same bias may be used for the three colors, or the bias may vary stepwise toward the rear stage); the secondary transfer bias to the transfer member=+1.8 kV (DC); and the transfer bias for transfer of a black toner image to the transfer medium=+2.0 kV (DC). The transfer bias for transfer of the three-color toner to the transfer medium may be equal to, or different from, the transfer bias for transfer of the black toner to the transfer medium.

As has been described above, according to the first embodiment, the indirect transfer method is used for the three colors, and the direct transfer method is used for black. Thereby, the edge of a black line is made sharp, the color reproducibility of a full-color image is kept unchanged, and the high image quality can be maintained from the beginning throughout the life.

Next, a second embodiment of the invention is described.

Figure 3:
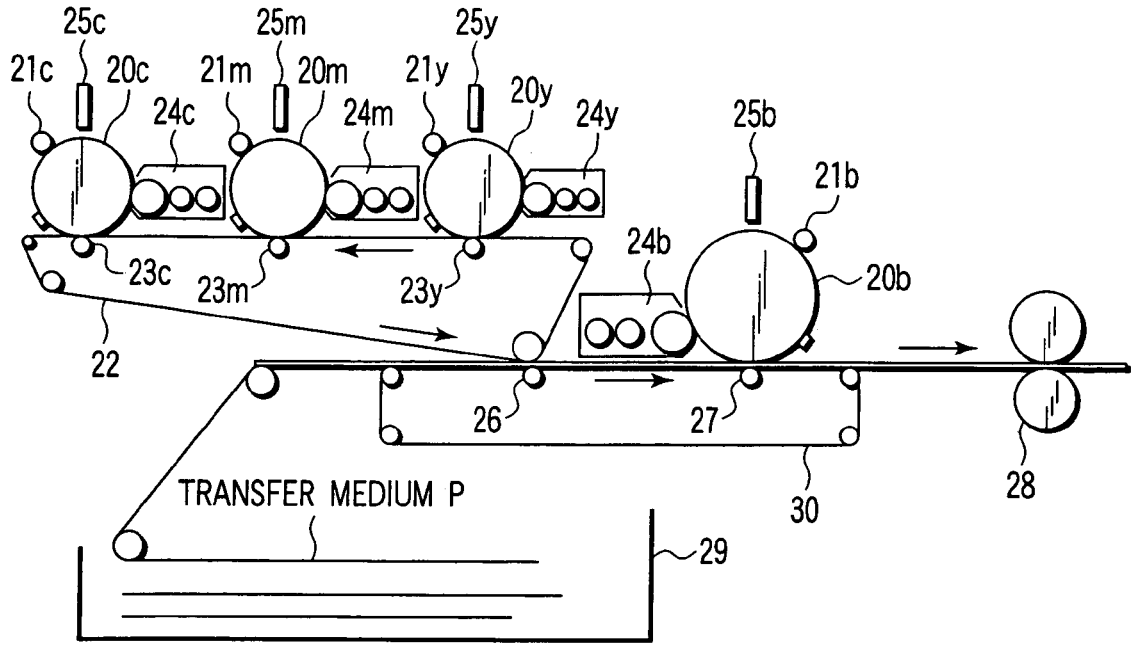
FIG. 3 schematically shows the structure of an image forming apparatus according to a second embodiment.

FIG. 3 schematically shows the structure of an image forming section according to a second embodiment. The image forming section of the second embodiment has a tandem configuration that comprises a photoconductor body, a charging device, an exposing device, a developing device and a transfer device in association with each of chromatic developers. The chromatic toners are intermediately transferred, and the black toner is directly transferred.

The intermediate transfer section of the tandem structure comprises photoconductor bodies 2O*y*, 20*m* and 20*c*, charging rollers 2l*y*, 21*m* and 21*c*, an intermediate transfer belt 22, primary transfer rollers 23*y*, 23*m* and 23*c*, developing devices 24*y*, 24*m* and 24*c*, laser optical systems 25*y*, 25*m* and 25*c*, and a secondary transfer roller 26.

The direct transfer section comprises a black photoconductor body 20*b*, a charging roller 21*b*, a black developing device 24*b*, a black laser optical system 25*b* and a transfer roller 27.

A transfer medium P is fed from a paper feed tray 29 to a convey belt 30. Cyan, magenta and yellow toners are intermediately transferred to the transfer medium P by the intermediate transfer belt 22 and secondary transfer roller 26. Black toner is directly transferred to the transfer medium P by the photoconductor body 20*b* and transfer roller 27, and the respective color toners are fixed by a fixing device 28.

Next, a description is given of an image forming operation under the control of the printer CPU 110 in the apparatus with the above-described structure.

The printer CPU 110 charges the respective photoconductor bodies 20*y*, 20*m* and 20*c* with a predetermined timing and forms electrostatic latent images by exposure using the associated laser optical systems 25*y*, 25*m* and 25*c*. Then, the printer CPU 110 develops the electrostatic latent images using the developing devices 24*y*, 24*m* and 24*c* and successively transfers the developed yellow, magenta and cyan toner images to the intermediate transfer belt 22 at predetermined positions in an overlapping fashion in accordance with the rotation of the intermediate transfer belt 22. In this case, a three-color toner image is formed by single passage of the intermediate transfer belt 22. The secondary transfer roller 26, which is opposed to the transfer medium convey path, is disposed at a position on the downstream side of the intermediate transfer belt 22. Using the secondary transfer roller 26, the printer CPU 110 transfers the three-color toner image at a time onto the transfer medium P that is fed from the paper feed tray 29 at a predetermined timing.

The transfer medium P is further conveyed by the convey belt 30 along the transfer medium convey path, and guided to a position facing the black photoconductor body 20*b*. A black toner image that is formed on the black photoconductor body 20*b* is transferred to the transfer medium P on which the three-color toner image is already present. The transfer medium P enters the fixing device 28 and the toner image is fixed there. Thus, the transfer medium P is discharged out of the apparatus.

As has been described above, according to the second embodiment, a full-color image and a monochromatic image can be formed at the same speed, and good sharpness of a black line and good color reproducibility can be obtained.

Next, a third embodiment is obtained.

In the third embodiment, each photoconductor body is not provided with a cleaning member that serves as a post-transfer residual toner recovering/discharging mechanism.

In order to efficiently recover post-transfer residual toner at a development area, a publicly known memory disturbing member, such as a stationary brush, a rotary brush, a transverse-sliding brush or a nonwoven fabric, may be disposed before or after a charge-erasing stage on the downstream side in the rotational direction of the photoconductor body, relative to the position of transfer to the intermediate transfer member (chromatic toners) and transfer section (black toner).

In addition, in order to once recover residual toner into a developing device, a temporary recover member that re-supplies toner onto the photoconductor body may be provided. The memory disturbing member and the temporary recover member may be supplied with a positive and/or negative voltage in order to efficiently implement their functions. The charging device for the photoconductor body may also have some or all of such similar functions.

The memory disturbing member is, for instance, a brush that is formed of electrically conductive fibers and has a contact resistance $10^7\Omega$ with the photoconductor body. This brush is disposed on the downstream side of a charge erase lamp around the photoconductor body, and a voltage of +300V is applied to the brush. The brush eliminates an image structure of the post-transfer residual toner, and the toner passes with such an adjusted charge as to permit easy recovery at the development area. Thereby, good simultaneous development/cleaning is realized.

A life test with a print ratio of 6% was conducted for a system having a toner recovery/discarding mechanism with a transfer efficiency of 93% for transfer of black toner to a transfer medium. The result is that the toner consumption per 1000 sheets was 30 g and the toner discharge amount was 6.5 g. On the other hand, with use of the simultaneous development/recovery system, the toner consumption per 1000 sheets was decreased to 24 g and the toner supply amount and waste toner box capacity were saved.

As has been described above, according to the third embodiment, the toner consumption efficiency can be improved by recovering post-transfer residual toner into the developing device and re-using the toner.

Next, a fourth embodiment is described.

In the fourth embodiment, a publicly known cleaning device, such as a rubber cleaning blade or a rotary brush with voltage applied, is put in pressure contact with the intermediate transfer belt, thereby recovering post-transfer residual toner on the intermediate transfer belt.

Assume now that due to a feed error of a transfer medium, the operation of the apparatus is halted, prior to execution of secondary transfer to the transfer medium, in the state in which a toner of one or more colors is already transferred from the photoconductor body to the intermediate transfer member. In the restoration operation in this case, at first, the development bias is lowered below an image area potential so as to prevent further development in a case where a non-developed electrostatic latent image remains on the photoconductor body. Alternatively, the developer carrying member is separated from the photoconductor body to prevent contact between the developer and the electrostatic latent image. Alternatively, the developer on the developer carrying member is recovered into the developing device.

Subsequently, a potential, which is closer to the photoconductor body surface potential than to the secondary transfer bias, is applied so as to prevent toner from being transferred to the transfer medium convey member at the secondary transfer section (in a case where the initial charging potential is −600V, the secondary transfer bias is set at +2 kV and the application bias to the secondary transfer means during the operation for restoration from jam is set at +1 kV to −600V). The intermediate transfer member, to which the toner adheres, passes through the contact area with the transfer medium convey member without transferring the toner. The toner on the intermediate transfer member is removed by the cleaning device that is disposed on the downstream side. The removed toner is discharged as waste toner.

Assume that due to a conveyance error of a transfer medium, the toner image on the intermediate transfer member is erroneously transferred to the transfer medium convey member, or the black toner developed on the photoconductor body is transferred to the transfer medium convey member. In this case, the apparatus starts a restoration-from-jam operation and effects switching between the first potential condition and the second potential condition. In addition, in order to prevent reverse transfer of the chromatic toner to the black photoconductor body, a voltage that is substantially equal to a voltage for transfer of toner to the transfer medium is applied to the black toner transfer means. In this case, the toner that is already developed on the black photoconductor body is transferred to the transfer medium convey member, and conveyed to the chromatic toner secondary transfer position by the rotation of the transfer medium convey member.

The secondary transfer means is supplied with such a voltage that toner is attracted from the transfer medium convey member to the intermediate transfer member. Hence, all four color toners on the transfer medium convey member are transferred to the intermediate transfer member. The toner is recovered by the cleaning device that is disposed on the downstream side of the intermediate transfer member, and is discharged as waste toner. In this case, the black toner transfer means is shifted away from the black photoconductor body, compared to the time of image formation, thereby preventing further transfer of the black toner, which remains on the photoconductor body, to the transfer medium convey member. The already developed black toner on the photoconductor body is recovered by the cleaning member that is provided on the photoconductor body. Alternatively, the black toner may be recovered by the developing device.

As has been described above, according to the fourth embodiment, there is no need to provide the transfer medium convey member with cleaning means. There is no possibility of degradation of the cleaning member itself, or degradation of the transfer medium convey member due to sliding friction. The maintenance is simplified. The life of a replaceable part is elongated, or a replaceable part itself may be dispensed with.

Furthermore, since the toner on the intermediate transfer member and the toner on the transfer medium convey member are recovered at one location, the structure for discharging waste toner can be simplified.

Next, a fifth embodiment is described.

In the fifth embodiment, the transfer medium convey member is provided with a publicly known cleaning device such as a rubber cleaning blade or a rotary brush with voltage applied.

When a feed error or a conveyance error of a transfer medium occurs, the operation of the image forming apparatus is stopped and the user is prompted to remove a transfer medium that is caught anywhere from the paper feed tray to the convey path. Thus, a restoration-from-jam operation is initiated.

At first, when a non-developed electrostatic latent image remains on the photoconductor body, a development bias is switched to a value equal to or lower than an image area potential, thereby to prevent further development. Alternatively, the developer on the developer carrying member is kept out of contact with the photoconductor body (for example, the photoconductor body belt backup roller is shifted, the developer carrying member is shifted, or the developer on the developer carrying member is recovered into the developing device).

Second, the toner that is already developed on the photoconductor body is transferred to the intermediate transfer member (chromatic toner) or transfer medium convey member (black toner). Alternatively, a voltage, with which primary transfer is not executed, is applied, and the toner is recovered by the cleaning member that is provided on the photoconductor body. Alternatively, the electrostatic latent image on the photoconductor body is erased by charge erase means, and then the toner is recovered into the developing device at the development area. The primary transfer means may be shifted from the transfer position so as to prohibit primary transfer.

Third, toner on the intermediate transfer member is all transferred to the transfer medium convey member at the secondary transfer position. A normal secondary transfer bias, or a different voltage, may be applied.

Fourth, the chromatic toner that is transferred from the intermediate transfer member, and the black toner that is transferred from the black photoconductor body are all recovered by the cleaning device that is provided on the downstream side of the black toner transfer position on the transfer medium convey member. The recovered toner is discharged as waste toner.

In the normal printing operation, after the toner is secondarily transferred from the intermediate transfer member to the transfer medium, it is possible to transfer the post-transfer residual toner on the intermediate transfer member to the convey member on which the transfer medium is not conveyed, and to recover the toner by the cleaning member that is provided on the convey member.

As has been described above, according to the fifth embodiment, the toner to be removed, which is present on the intermediate transfer member and on the transfer medium convey member, can be recovered at a time. Thereby, the structure can be simplified, the number of replaceable parts can be reduced, and abrasion of the intermediate transfer member can be prevented.

Next, a sixth embodiment is described.

In the sixth embodiment, post-secondary-transfer residual toner on the intermediate transfer member is transferred to the transfer medium convey member. At the contact position with the black photoconductor body, the transfer means is applied with a voltage so as to generate an electric field that shifts the toner toward the black photoconductor body. Thus, the toner is transferred to the black photoconductor body, and the toner is recovered into the developing device at a position facing the black developing device.

This embodiment is combined with the simultaneous development/cleaning by which post-transfer residual toner on the photoconductor bodies is all recovered into the associated developing devices. Thus, the post-transfer residual toner on the photoconductor bodies is all recovered into the associated developing devices. In addition, the post-transfer residual toner on the intermediate transfer member is recovered from the black photoconductor body into the black developing device via the transfer medium convey member. Hence, no waste toner to be discharged is produced.

It is preferable to start the transfer operation of each photoconductor body after confirming that the transfer medium is conveyed to a predetermined position, thereby to avoid recovery of the transfer toner on the intermediate transfer member or cleaning of the transfer toner on the transfer medium convey member due to a paper feed error, etc.

Next, a seventh embodiment is described.

In the seventh embodiment, spherical toner is obtained by a chemical method such as an emulsification polymerization/association method, a suspension polymerization method or a melting granulation method, or by an ensphering process using heating and friction of pulverized toner.

Figure 4:
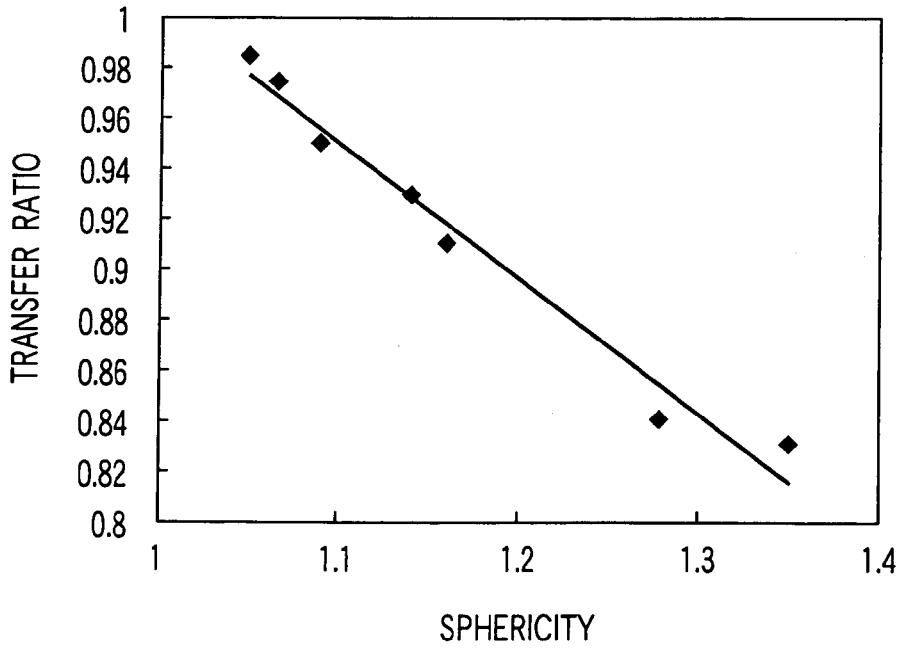
FIG. 4 is a graph showing the relationship between sphericity and transfer efficiency.

FIG. 4 shows a relationship between sphericity and transfer efficiency.

The sphericity in FIG. 4 is a numerical value that is expressed by a ratio De/Ds between a Stokes diameter (Ds) and an equivalent volume diameter (De). The spherical toner refers to toner that is considered to be spherical by a relational formula, $De/Ds \leqq 1.2$ (Jpn. Pat. Appln. KOKAI Publication No. 5-303233), or other publicly known formulae that stipulate sphericity.

When suspension-polymerized toner with a sphericity of 1.07 was used, the efficiency of transfer of chromatic toner from the photoconductor body to the intermediate transfer member was 98.5%, the efficiency of transfer from the intermediate transfer member to the transfer medium was 95%, and the efficiency of transfer of black toner from the photoconductor body to the transfer medium was 97%. Since the transfer efficiency is very high and the amount of post-transfer residual toner is small, recovery of toner in the developing device can satisfactorily be performed. The result of a life test, which was conducted while post-transfer residual toner on the intermediate transfer member was being recovered to black developer, shows that the density or chroma of a black image did not change visibly.

Next, an eighth embodiment is described.

In the eighth embodiment, in the secondary transfer section where toner is transferred from the intermediate transfer member to the transfer medium, contact between the intermediate transfer member and the transfer medium is released by shifting a backup roller that is provided behind the intermediate transfer member.

Figure 5:
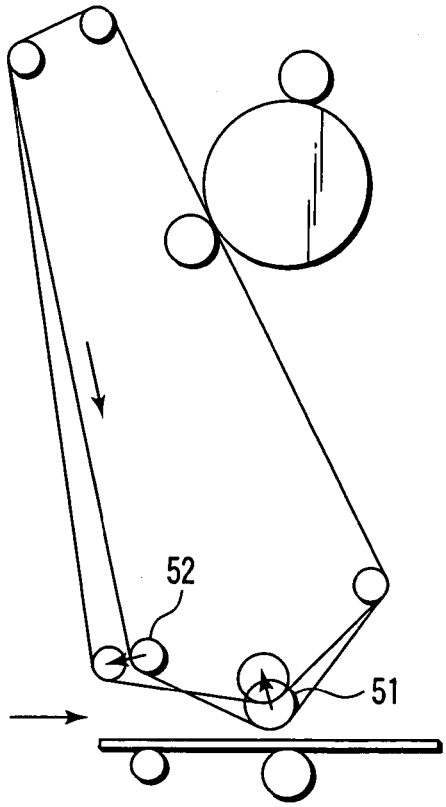
FIG. 5 shows an example of a separating structure for an intermediate transfer belt.

FIG. 5 shows an example of the separating structure for the intermediate transfer belt in the image forming apparatus shown in FIG. 2. Specifically, the CPU 110 instructs the separation control unit 118 to shift backup rollers 51 and 52, thereby releasing contact at the secondary transfer section.

Figure 6:
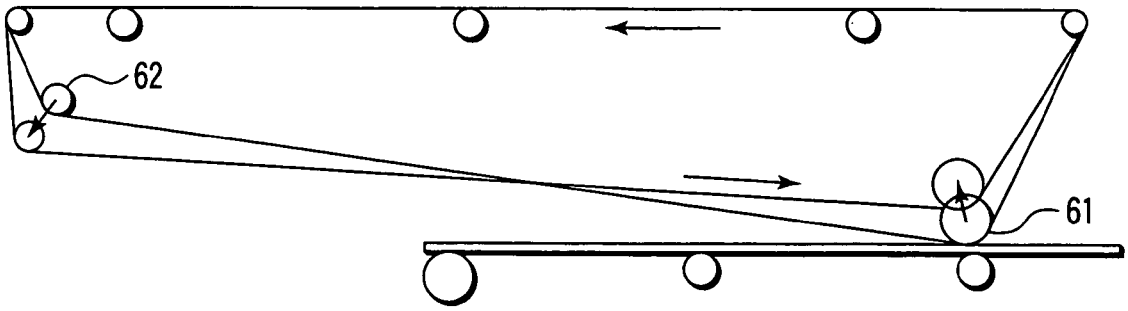
FIG. 6 shows an example of a separating structure for an intermediate transfer belt.

FIG. 6 shows an example of the separating structure for the intermediate transfer belt in the image forming apparatus shown in FIG. 3. Specifically, the CPU 110 instructs the separation control unit 118 to shift backup rollers 61 and 62, thereby releasing contact at the secondary transfer section.

As has been described above, according to the eighth embodiment, contact at the contact area can be released with a small number of structural components. Therefore, at the time of printing with a single color of black, the operation of the chromatic color image forming unit can easily be halted.

Next, a ninth embodiment is described.

In the ninth embodiment, toner is composed in the following manner.

Toner was kneaded, pulverized and classified with a ratio of 90 wt % of polyester resin, 7 wt % of pigment and 3 wt % of rice wax. The resultant was combined with external additive of silica, CCA and titanium oxide particles. Thus, toner particles with a volume mean grain size of 7.5 um were obtained. A molecular weight distribution of resin used has a sharp curve with a single peak. The glass transition point of the toner was 64° C., and the softening point Ti of the toner was 84° C. The toner was mixed with a magnetic carrier with a volume mean grain size of 40 um, which is composed of ferrite particles that are surface-coated with silicone resin, with a toner content ratio of 7 wt %. The mixture was stirred and a two-component developer was formed.

The fixing device comprises a heating roller (outside diameter: 40 mm) that is put in direct contact with toner, and a press roller (outside diameter: 40 mm) that is put in contact with the back surface of the transfer medium.

The heating roller has such a stacked structure that a core metal (stainless steel, aluminum, iron, nickel, or other various alloys) with a wall thickness of, e.g. 3 mm is coated with solid rubber (silicone rubber, fluoro-rubber, etc.) with a thickness of 1 to 2 mm, and further the surface is coated with a release layer with a thickness of about 50 um. A heater lamp is disposed at the center of the core metal. In addition, the heating roller is provided with thermistors (two or more along the longitudinal direction of the heating roller) for detecting the temperature of the heating roller and a thermostat (at least one on the H/R) for detecting abnormality in surface temperature of the heating roller and turning off heating.

The press roller may have the same structure as the heating roller. Alternatively, the press roller may not be provided with a heater lamp, and may have a thicker solid rubber layer. The press roller may not have a surface release layer. The pressing force of the press roller and the elasticity of the solid rubber create a nip of 3 to 12 mm, preferably 5 to 10 mm.

The monochromatic fixing device, unlike the color fixing device, has no elastic rubber layer on the heating roller, thus enabling fixation at higher temperatures and higher speed. In the case of color image fixation, a relatively long nip (fixation time) is required in order to sufficiently melt color toners, and the provision of the elastic rubber layer on the heating layer does not permit fixation at too high temperatures because of the problem of a limit to heat resistance. This is a factor to prevent a higher-speed process of the full-color image forming apparatus.

In order to fix the color toner image at a process speed of 130 mm/sec, the temperature of the heating roller is set at 150° C. and the nip width is set at 7 mm. The fixation time is 62 seconds.

With this fixing device, the color toners are mutually melted to exhibit transparency, and good color reproducibility is obtained. However, in the case of a single-color image, in particular, there is no need to sufficiently melt the black toner to exhibit transparency. The black toner, if pressed at temperatures above the softening point Ti, is fixed on the transfer medium. For example, assume that a toner layer with a temperature of 20° C. enters the fixing device whose heating roller is set at 150° C., and the temperature of the toner layer reaches about 150° C. in the vicinity of the exit of the nip. In this case, 30 seconds, i.e. about half the time, is needed to reach the softening point Ti of 84° C. Taking into account the time that is needed until the softened toner fluidizes and enters among paper fibers, it may be considered that the black toner is fixed within about ⅔ of the time for the color toners.

Therefore, the process speed for black single-color printing can be increased by 1.5 times. Without changing the temperature setting and geometrical conditions of the fixing device, black single-color images can be formed at a rate of 45 sheets/min. in the full-color image forming apparatus with an output speed of 30 sheets/minutes.

Next, a tenth embodiment is described.

An image forming apparatus according to the tenth embodiment adopts an indirect transfer system for chromatic toners and a direct transfer system for a black toner. A chromatic image forming unit and a black image forming unit are separately driven.

At the time of black single-color printing, the secondary transfer position of the chromatic toner intermediate transfer member is separated from the transfer medium, and the operation of the chromatic image forming unit is halted. The speed of the black image forming unit and transfer medium convey system is increased up to 1.2 to 2 times the normal speed. Thus, a black single-color image is printed.

According to the tenth embodiment, even when the speed was increased, the fixing properties of the black toner were good, and the image quality, etc. was excellent.

Moreover, with the tandem structure of the chromatic image forming unit, both the full-color image forming speed and the black image forming speed can satisfactorily be increased.

Next, an eleventh embodiment is described.

In an image forming apparatus according to the eleventh embodiment, the circumferential length of the photoconductor body of the black image forming unit is made 1.5 times greater than that of the chromatic-color photoconductor body. In addition, the space for storing the black developer is made 1.5 times greater than that for storing the chromatic developer, and also the diameter of the developer carrying member is made 1.5 times greater.

Thereby, the number of printable sheets up to the end of life was increased about 1.5 times.

The operation of the chromatic image forming unit is stopped while the black single-color printing is executed. Thereby, the rate of degradation of the chromatic image forming unit can be decreased, relative to the total number of print sheets of the image forming apparatus.

If the black image forming unit and the chromatic image forming unit are designed with the same size, the black image forming unit would be degraded earlier. However, since the black image forming unit is designed to be 1.5 times greater in size, the rate of degradation of the chromatic image forming unit and the rate of degradation of the black image forming unit can be made substantially equal, relative to the total number of print sheets of the image forming apparatus.

As has been described above, according to the eleventh embodiment, the maintenance cycle for both the image forming units is made equal, and the maintenance service can efficiently be performed.

Next, a twelfth embodiment is described.

In the twelfth embodiment, the pulverized toner, which was described in connection with the ninth embodiment, was ensphered by a suffusing process, and spherical toner with a mean sphericity of 1.09 was obtained. The toner was mixed with a magnetic carrier with a volume mean grain size of 43 um, which is composed of ferrite particles that are surface-coated with silicone resin, with a toner content ratio of 7 wt %. Thus, a two-component developer was obtained.

The chromatic image forming unit has a tandem configuration. The diameter of the photoconductor drum is 30 mm. The photoconductor drum is uniformly charged at −650V by a scorotron charger, and an image area on the photoconductor drum is exposed by a semiconductor laser and discharged. Thus, an electrostatic latent image is formed.

The developing device stores 300 g of the two-component developer. A magnetic brush is formed on the developing roller with an outside diameter of 18 mm. The developing roller and photoconductor body are opposed to each other with a distance of 500 um. A development bias of −350V is applied to the developing roller.

An electrostatic latent image corresponding to yellow image data is formed on the first photoconductor body, and the electrostatic latent image on the first photoconductor body is developed with yellow toner from the first developing device. By the rotation of the first photoconductor body, the developed toner image is conveyed to a position facing the intermediate transfer belt. The intermediate transfer belt is formed of polyimide with a volume resistance of $10^9\Omega$. A first electrically conductive elastic rubber roller is disposed behind the intermediate transfer belt that faces the first photoconductor body. A voltage of +500V is applied, and the toner on the photoconductor body is transferred to the intermediate transfer belt.

Similarly, a magenta toner image formed on the second photoconductor body is conveyed to a second primary transfer region where the second photoconductor body contacts a second electrically conductive elastic rubber roller and the intermediate transfer belt. A voltage of +480V is applied to the second electrically conductive elastic rubber roller, and the magenta toner image is registered with the yellow image and transferred.

Further, a cyan toner image is similarly transferred at a third primary transfer position by applying a voltage of +470V to a third electrically conductive rubber roller.

After each toner image is transferred, post-transfer residual toner of about 5% to 7% remains on the photoconductor body. After transfer, the electrostatic latent image remaining on the photoconductor body is passed over the charge erase lamp and erased. An image structure of the post-transfer residual toner is disturbed by an electrically conductive fiber brush (with a contact resistance of $10^8\omega$) that is disposed on the downstream and is supplied with a voltage of +300V. The photoconductor body is charged again, exposed, and moved to the development region.

At this time, post-transfer residual toner adhering to a non-image part of a new electrostatic latent image is attracted by an electric field that is generated by a development bias and the photoconductor body and is recovered into the developing device. Thus, simultaneous development/cleaning is executed.

After the three-color toner images are registered and transferred on the intermediate transfer belt, the transferred image is conveyed by the rotation of the intermediate transfer belt and reaches the position facing the transfer medium convey path. At a predetermined timing, a transfer medium is fed from the paper feed tray, and the transfer medium is electrically attracted to the transfer medium convey belt and conveyed.

The transfer medium comes in contact with the toner image on the intermediate transfer belt. With application of a transfer bias of +2 kV by the electrically conductive elastic rubber transfer roller disposed behind the convey belt, the three-color toner images are secondarily transferred to the transfer medium at a time.

The transfer medium convey belt is formed of polyimide and has a volume resistance of $10^{11}\Omega$. On the other hand, the black photoconductor drum has a diameter of 45 mm. The photoconductor drum is uniformly charged at −650V by a scorotron charger, and the surface potential is discharged by a semiconductor laser in accordance with black image data. Thus, an electrostatic latent image is formed. The black developing device stores 450 g of a black two-component developer. A magnetic brush for the black developer is formed on the developing roller with an outside diameter of 27 mm. The developing roller and photoconductor body are opposed to each other with a distance of 500 um. A development bias of −350V is applied to the developing roller.

An electrostatic latent image that is formed on the black photoconductor body is developed with black toner. By the rotation of the photoconductor body, the developed toner image is conveyed to a position facing the transfer medium convey belt. An electrically conductive elastic rubber roller is disposed behind the convey belt at the position facing the photoconductor body. The photoconductor body, conveyed transfer medium, convey belt and transfer roller come in contact. With application of a voltage of +1.8 kV to the transfer roller, the black toner image on the photoconductor body is transferred to the transfer medium over the three-color toner image.

The transfer medium is separated from the convey belt and guided into the fixing device. The toner image is fixed by heat and pressure, and the transfer medium with the fixed image is output.

The black photoconductor body is constructed similarly with the chromatic photoconductor body, and simultaneous development/cleaning is executed.

At the time of black single-color printing, the backup roller, which is disposed behind the intermediate transfer belt at the secondary transfer position of the chromatic toner, is shifted by 2 mm to 10 mm in a direction away from the transfer medium (consequently, at least one of tension rollers for maintaining the tension of the intermediate transfer belt is shifted). As a result, the secondary transfer contact region is set in the out-of-contact state, and the operation of the chromatic image forming unit (developing device, photoconductor body, intermediate transfer belt, and power supply for supplying voltages for charging, development, transfer, charge-erasure and memory disturbance) is halted.

A transfer medium that is fed from the paper feed tray is attracted to the transfer medium convey belt, and the transfer medium passes by the chromatic toner secondary transfer region, while undergoing no processing. At the black toner transfer position, the toner image is transferred to the transfer medium from the black photoconductor body and is fixed. At this time, the process speed is increased 1.2 to 2 times, and the black single-color image can be obtained at high speed. In this case, too, there is no need to change the set temperature of the fixing device, etc.

Since the toner is subjected to the ensphering process, it has a higher transfer efficiency than non-processed toner. However, since the apparatus has the tandem structure, the primary transfer bias is set at a level lower than a level at which a maximum transfer efficiency is obtained, thereby minimizing the possibility of reverse transfer. A relatively large amount of post-transfer residual toner is disturbed by the memory disturbing brush, and the toner is recovered into the developing device and re-used. Thereby, the toner can efficiently be used without producing waste toner.

At the secondary transfer position, there is no fear of reverse transfer, and the transfer condition with the maximum transfer efficiency can be selected. However, the intervening transfer medium has a variable resistance due to its thickness or moisture content. Even if such parameters are detected and the optimal transfer bias is chosen, a slight amount of post-transfer residual toner is always present. Since the post-transfer residual toner on the intermediate transfer medium contains a mixture of three color toners, it is impossible to recover the mixture toner into the respective color developing devices as such.

Thus, the post-transfer residual toner is transferred to that part of the transfer medium convey path, on which the transfer medium is not conveyed (transfer is possible at almost 100% to the transfer medium convey belt that has a smooth surface and a stable resistance value). A voltage of about +300V is applied to the transfer roller at the black transfer position where the toner is transferred from the black photoconductor body to the transfer medium. Further, an electric field is generated by charging the surface of the photoconductor body, thereby transferring the post-transfer residual chromatic toner to the black photoconductor body.

The toners are positively charged by a high positive voltage that is applied at the time of transfer from the intermediate transfer belt to the transfer medium convey belt. By negatively charging the black photoconductor body, the post-transfer residual toner can be transferred to the photoconductor body.

In the embodiments, the chromatic toners are developed and transferred in the order of yellow, magenta and cyan. The order is not limited to this.

The optimal values of the respective potentials are variable due to environmental conditions of temperatures and humidity and time-dependent variations due to the life of the apparatus. These values are changed by the image-maintaining process, and are not limited to the values as mentioned above.

As has been described above, the embodiments of the invention can meet the requirements relating to the image qualities of both a full-color image and a monochromatic image.

In addition, the embodiments can meet the requirements relating to the print speed for a full-color image forming apparatus and the print speed for a monochromatic image forming apparatus.

Furthermore, the toner consumption efficiency can be enhanced, and no waste toner is produced. The life of various consumable parts can be elongated, and the maintenance is facilitated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color image forming apparatus that has a plurality of image carrying bodies and forms a color image, comprising:

first image forming means for forming toner images of chromatic colors other than black with a first laser exposure;

primary transfer means for transferring the toner images, which are formed by the first image forming means, to an intermediate transfer member;

secondary transfer means for transferring the toner images, which are transferred to the intermediate transfer member by the primary transfer means, to a transfer medium;

second image forming means for forming a black toner image with a second laser exposure, wherein a sphericity of the black toner for forming the black toner image is at most 1.2; and direct transfer means for directly transferring the black toner image, which is formed by the second image forming means, to the transfer medium on which the toner images are transferred by the secondary transfer means, wherein the first image forming means includes an image carrying body that carries an electrostatic latent image on a surface thereof, exposure means for exposing the image carrying body on the basis of color image data and forming an electrostatic latent image, and a developing device of a plurality of different chromatic toners, which develops the electrostatic latent image that is formed by the exposure means, wherein a development bias is lowered below an image area potential so as to prevent further development in a case where a non-developed electrostatic latent image remains on the image carrying body of the first image forming means.

2. The color image forming apparatus according to claim 1, wherein a potential of the secondary transfer means is closer to the image carrying body surface potential than to a secondary transfer bias.

3. The color image forming apparatus according to claim 2, wherein the primary transfer means successively overlaps toner images of a plurality of colors, which are formed by the first image forming means, and transfers the toner images to the intermediate transfer member.

4. The color image forming apparatus according to claim 2, further comprising means for separating, when a black single-color image is to be formed, the intermediate transfer member from a convey means for conveying the transfer medium, and stopping operations of the first image forming means and the intermediate transfer member.

5. The color image forming apparatus according to claim 4, further comprising control means for executing, when a black single-color image is to be formed, a control to make a speed of forming an image by the second image forming means higher than a speed of forming a color image.

6. The color image forming apparatus according to claim 2, wherein the second image forming means is configured such that a part or all of units that constitute the first image forming means are formed with a large size.

7. The color image forming apparatus according to claim 2, wherein the intermediate transfer member, to which the toner adheres, passes through a contact area with a transfer medium convey member without transferring the toner.

8. A color image forming apparatus that has a plurality of image carrying bodies and forms a color image, comprising:

first image forming means for forming toner images of chromatic colors other than black with a first laser exposure;

primary transfer means for transferring the toner images, which are formed by the first image forming means, to an intermediate transfer member;

secondary transfer means for transferring the toner images, which are transferred to the intermediate transfer member by the primary transfer means, to a transfer medium;

second image forming means for forming a black toner image with a second laser exposure, wherein a sphericity of the black toner for forming the black toner image is at most 1.2; and direct transfer means for directly transferring the black toner image, which is formed by the second image forming means, to the transfer medium on which the toner images are transferred by the secondary transfer means, wherein the first image forming means includes a number of sets, which corresponds to a number of chromatic toners, each set comprising an image carrying body that carries an electrostatic latent image on a surface thereof, exposure means for exposing the image carrying body on the basis of color image data and forming an electrostatic latent image, and a developing device which develops the electrostatic latent image that is formed by the exposure means, wherein a development bias is lowered below an image area potential so as to prevent further development in a case where a non-developed electrostatic latent image remains on at least one of the image carrying bodies of the first image forming means.

9. The apparatus according to claim 8, wherein a potential of the secondary transfer means is closer to the image carrying body surface potential than to a secondary transfer bias.

10. The apparatus according to claim 9, wherein the intermediate transfer member, to which the toner adheres, passes through a contact area with a transfer medium convey member without transferring the toner.

11. An image forming method for a color image forming apparatus that has first and second image carrying bodies and forms a color image, comprising:

forming toner images of chromatic colors other than black with a first laser exposure;

primarily transferring the toner images of chromatic colors other than black, which are formed using the first image carrying body, to an intermediate transfer member;

secondarily transferring the toner images of the chromatic colors other than black, which are primarily transferred to the intermediate transfer member, to a transfer medium;

forming a black toner image with a second laser exposure; and directly transferring the black toner image, which is formed using the second image carrying body, to the transfer medium on which the toner images are secondarily transferred, wherein a sphericity of the black toner for forming the black toner image is at most 1.2, wherein the first image carrying body includes first image forming means for forming a yellow toner image, second image forming means for forming a magenta toner image and third image forming means for forming a cyan toner image, and the toner images of the chromatic colors of yellow, magenta and cyan are successively primarily transferred to the intermediate transfer member, wherein the first image carrying body includes a number of sets, which corresponds to a number of chromatic toners, each set comprising an image carrying body that carries an electrostatic latent image on a surface thereof, exposure means for exposing the image carrying body on the basis of color image data and forming an electrostatic latent image, and a developing device which develops the electrostatic latent image that is formed by the exposure means, wherein a development bias is lowered below an image area potential so as to prevent further development in a case where a non-developed electrostatic latent image remains on the first image carrying body.

12. The image forming method according to claim 11, wherein toner images of chromatic colors of yellow, magenta and cyan are successively formed using the first image carrying body, and the formed chromatic toner images are successively primarily transferred to the intermediate transfer member.

13. The image forming method according to claim 11, wherein when a black single-color image is to be formed, the intermediate transfer member is separated from a convey member that conveys the transfer medium, and operations of the first image carrying body and the intermediate transfer member are stopped.

14. The image forming method according to claim 11, wherein when a black single-color image is to be formed, a control is executed to make a speed of forming an image by the second image carrying body higher than a speed of forming a color image.

15. The image forming method according to claim 11, wherein a potential of the secondary transfer means is closer to the image carrying body surface potential than to a secondary transfer bias.

16. The color image forming method according to claim 15, wherein the intermediate transfer member, to which the toner adheres, passes through a contact area with a transfer medium convey member without transferring the toner.

* * * * *